US012767368B2

(12) United States Patent
Huang

(10) Patent No.: US 12,767,368 B2
(45) Date of Patent: Oct. 20, 2026

(54) TAPE WETTING DEVICE IN CARTON SEALER

(71) Applicant: FUJIAN JIALONG ADHESIVE TAPE CO., LTD., Zhangzhou (CN)

(72) Inventor: Benyu Huang, Ningde (CN)

(73) Assignee: Kingnode America Inc., Atlanta, GA (US)

( * ) Notice: Subject to any disclaimer, the term of this patent is extended or adjusted under 35 U.S.C. 154(b) by 409 days.

(21) Appl. No.: 18/410,965

(22) Filed: Jan. 11, 2024

(65) Prior Publication Data

US 2025/0229929 A1 Jul. 17, 2025

(51) Int. Cl.
*B65B 51/06* (2006.01)
*B65H 35/00* (2006.01)

(52) U.S. Cl.
CPC ..... *B65B 51/067* (2013.01); *B65H 35/0046* (2013.01)

(58) Field of Classification Search
None
See application file for complete search history.

(56) References Cited

U.S. PATENT DOCUMENTS 1,467,421 A * 9/1923 Crowell ..... B65H 35/0046 118/235
1,749,407 A * 3/1930 Beach ..... B65H 35/0046 118/249
2,565,451 A * 8/1951 Hoitt ..... B65C 11/04 118/42
2,710,590 A * 6/1955 Gerard ..... B65H 35/0046 118/43
12,024,389 B2 * 7/2024 Huang ..... B65H 35/0046
2014/0026810 A1 * 1/2014 Lazzaroni ..... B65H 35/0046 118/231
2024/0327163 A1 * 10/2024 Kim ..... B65H 35/0046

FOREIGN PATENT DOCUMENTS

CN 212712037 U 3/2021
CN 113291911 A 8/2021
CN 219259109 U 6/2023
WO WO-2022055247 A1 * 3/2022 ..... B65H 35/0046

* cited by examiner

*Primary Examiner* — Binu Thomas
(74) *Attorney, Agent, or Firm* — Nitin Kaushik

(57) ABSTRACT

The present disclosure provides a tape wetting device in a carton sealer. The device includes a water containing bottle, a first water tank, a second water tank and a wetting roller. The water containing bottle is disposed on the first water tank, the wetting roller is arranged on the second water tank, the first water tank communicates with the second water tank, and the wetting roller is wetted with the water in the second water tank. When a tape passes through the wetting roller, the rotating wetting roller is in contact with the tape, so that an adhesive surface of the tape transfers and absorbs water attached to a roller surface of the wetting roller; and at the same time, the area of contact between the tape and the wetting roller is limited and controlled by pressing plates, so that a wetting effect of the tape is guaranteed.

9 Claims, 8 Drawing Sheets

TAPE WETTING DEVICE IN CARTON SEALER

TECHNICAL FIELD

The present disclosure relates to the field of carton sealer structures, in particular to a tape wetting device in a carton sealer.

BACKGROUND

A tape consists of two parts including a substrate and a binder and connects two or more disconnected objects together by binding, and the surface thereof is coated with a layer of adhesive. At present, a carton sealer usually adopting a self-adhesive tape such as a transparent tape is not provided with a wetting mechanism so as not to be applicable to a wet tape.

SUMMARY

For overcoming defects proposed in the above-mentioned background art, the present disclosure provides a tape wetting device in a carton sealer.

The present disclosure adopts the following technical solution:

provided is a tape wetting device in a carton sealer, wherein the device includes a water containing bottle, a first water tank, a second water tank and a wetting roller, wherein a one-way valve is mounted on a bottleneck of the water containing bottle, the one-way valve is for circulation from the inside to the outside of the water containing bottle, and the water containing bottle is located in the first water tank in a way that the bottleneck faces downwards;

the first water tank communicates with the second water tank, so that water in the first water tank is capable of circulating to the second water tank; and the wetting roller is limited to rotate on the second water tank, a lower surface of the wetting roller is located below a water level in the second water tank, and a tape is stuck to an upper surface of the wetting roller so as to be conveyed.

In a possible implementation, a bearing block and a wetting motor are fixed on a mounting frame of the carton sealer, one end of the wetting roller is fixed into the bearing block, and the wetting motor drives the wetting roller to rotate.

In a possible implementation, a rotating shaft is fixed on one end of the wetting roller, the rotating shaft is fixedly connected to a first synchronous wheel after passing through the bearing block, an output shaft of the wetting motor is fixedly connected to a second synchronous wheel, and the first synchronous wheel and the second synchronous wheel are both engaged and connected with a synchronous belt.

In a possible implementation, pressing plates are fixed above the wetting roller, the tape passes by a gap between each of the pressing plates and the wetting roller, and the pressing plates press against the tape.

In a possible implementation, a mounting plate is fixed on the carton sealer, the first water tank is fixed below the mounting plate, the mounting plate is provided with a water replenishing frame on the first water tank, an avoidance hole and a limiting hole are respectively formed in upper and lower surfaces of the water replenishing frame, the aperture of the avoidance hole is larger than the external diameter of the water containing bottle, and the aperture of the limiting hole is smaller than the external diameter of the water containing bottle; and after the water containing bottle passes through the avoidance hole, the bottleneck part of the water containing bottle passes through the limiting hole and extends into the first water tank.

In a possible implementation, the water replenishing frame is provided with vertical strip-shaped holes, the mounting plate is provided with connecting holes, and after passing through the strip-shaped holes and the connecting holes, bolts are spirally connected to second nuts until being fastened, so that the water replenishing frame is fixed above the first water tank.

In a possible implementation, a plurality of guide plates are further disposed on one side of the wetting roller, and surfaces on upper ends of the guide plates are tangent to a surface of the wetting roller.

In a possible implementation, a heatable heating plate is fitted and fixed to the bottom surface of the second water tank.

In a possible implementation, a fixing plate is disposed on the bottom surface of the second water tank, and the heating plate is located between the bottom surface of the second water tank and the fixing plate; and studs are fixed on the bottom surface of the second water tank and are spirally connected to first nuts, all corners of the fixing plate are provided with fixing holes, after the studs are sleeved in the fixing holes, the first nuts and the studs are spirally fastened on a side, facing away from the second water tank, of the fixing plate.

It can be known from the description for the structure of the present disclosure, compared with the prior art, the present disclosure has the following advantages: after the tape wetting device is disposed on the carton sealer, due to the contact between the rotating wetting roller and the tape when the tape passes through the wetting roller, an adhesive surface of the tape transfers and absorbs water attached to a roller surface of the wetting roller; and at the same time, the area of contact between the tape and the wetting roller is limited and controlled by the pressing plates, so that a wetting effect of the tape is guaranteed. Thus, it can be seen that, by using the tape wetting device, water can be automatically attached to the tape during the conveyance of the tape, and the conveyance of the tape is not affected. Therefore, after the tape wetting device is added, the carton sealer is applicable to a wet tape.

DETAILED DESCRIPTION OF THE EMBODIMENTS

In order to make objectives, technical solutions and advantages of the present application clearer, the present application will be further described in detail below in conjunction with the accompanying drawings.

Below, terms such as "first" and "second" are for descriptive purposes only, and cannot be understood as indicating or implying the relative importance of implicitly indicating the number of indicated technical features. Therefore, the features defined as "first" and "second" may explicitly or implicitly include at least one of the features.

In addition, in the present application, directional terms such as "upper" and "lower" are defined relative to directions where components are schematically placed in the accompanying drawings. It should be understood that these directional terms are relative concepts, are used for relative description and clarification, and can be changed accordingly according to the change of the directions where the components are placed in the accompanying drawings.

Figure 1:
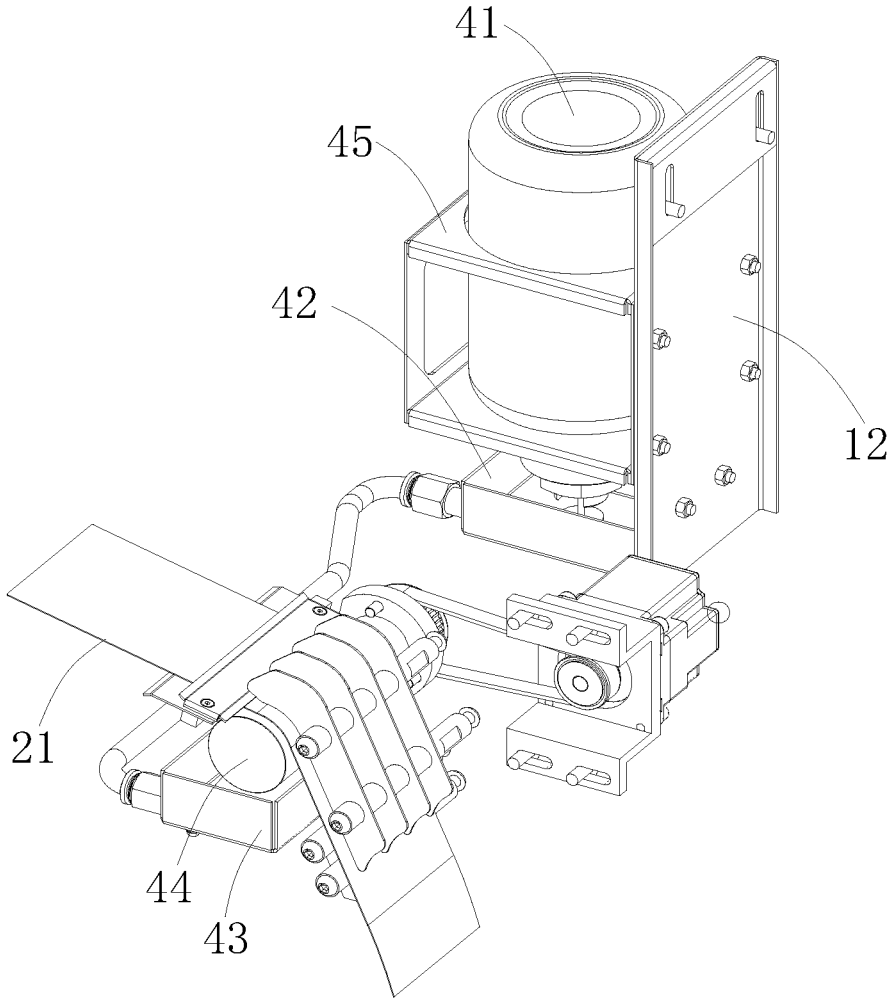
FIG. 1 is a schematic view of a three-dimensional structure of the present disclosure.
Figure 2:
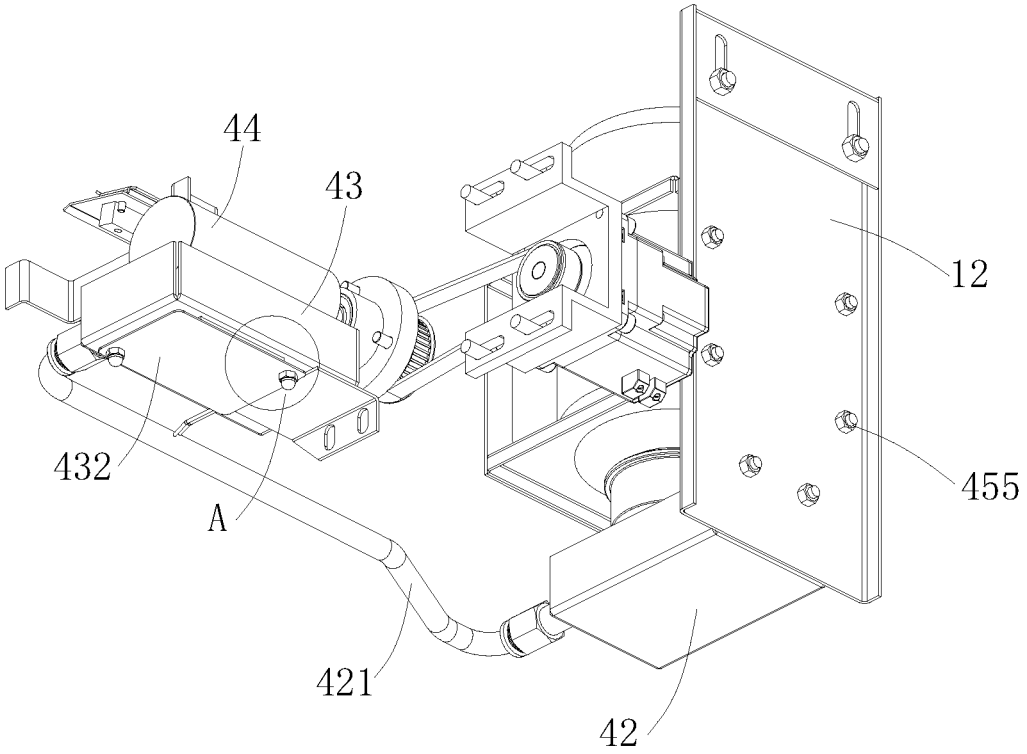
FIG. 2 is a schematic view of a three-dimensional structure viewed from a bottom of the present disclosure.

The present disclosure discloses a tape wetting device in a carton sealer, as shown in FIG. 1 and FIG. 2, the device includes a water containing bottle 41, a first water tank 42, a second water tank 43 and a wetting roller 44, wherein the water containing bottle 41 is disposed on the first water tank 42, the wetting roller 44 is disposed on the second water tank 43, the first water tank 42 and the second water tank 43 are both fixed on a mounting frame (unshown in the figures) of the carton sealer, and the first water tank 42 and the second water tank 43 communicate by the connection of a connecting pipe 421, so that water in the first water tank 42 is capable of circulating to the second water tank 43.

Figure 3:
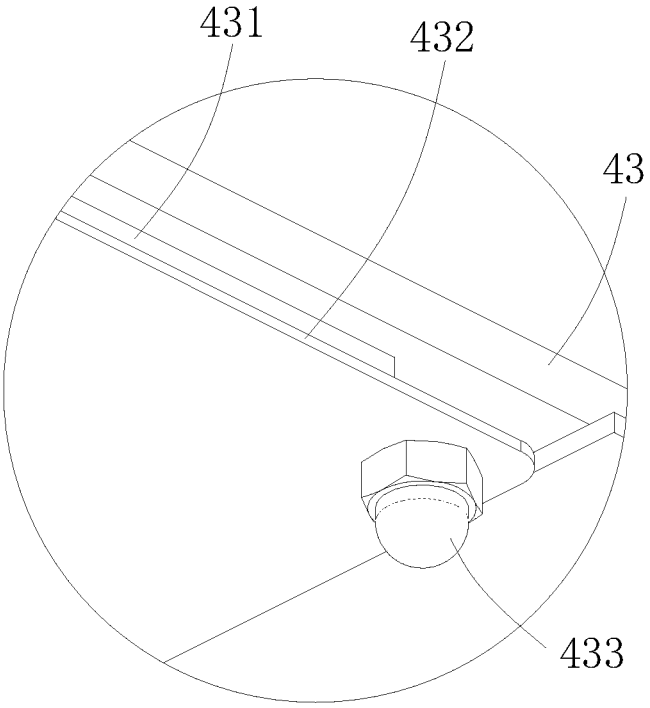
FIG. 3 is a schematic enlarged view of part A in FIG. 1.

As shown in FIG. 2 and FIG. 3, a heatable heating plate 421 is fitted and fixed to the bottom surface of the second water tank 43, the heating plate 431 may be an electric heating plate made of silicon rubber, and the second water tank 43 is heated by the heating plate 431, which avoids the situation that the water in the second water tank 43 freezes in a cold environment. The heating plate 431 can be fitted to the bottom surface of the second water tank 43 by the connection of a fixing plate 432. Specifically, a plurality of studs (unshown in the figures) are fixed on the bottom surface of the second water tank 43, all the studs are spirally connected to first nuts 433, corresponding corners of the fixing plate 432 are provided with fixing holes v, after the heating plate 431 is placed between the bottom surface of the second water tank 43 and the fixing plate 432, all the studs are sleeved in the fixing holes of the fixing plate 432, and then, the first nuts 433 and the studs are spirally fastened on a side, facing away from the second water tank 43, of the fixing plate 432, so that the heating plate 431 is pressed on the bottom surface of the second water tank 43 by the fixing plate 432, and then, the heating plate 431 can be fitted to the bottom surface of the second water tank 43.

Figure 6:
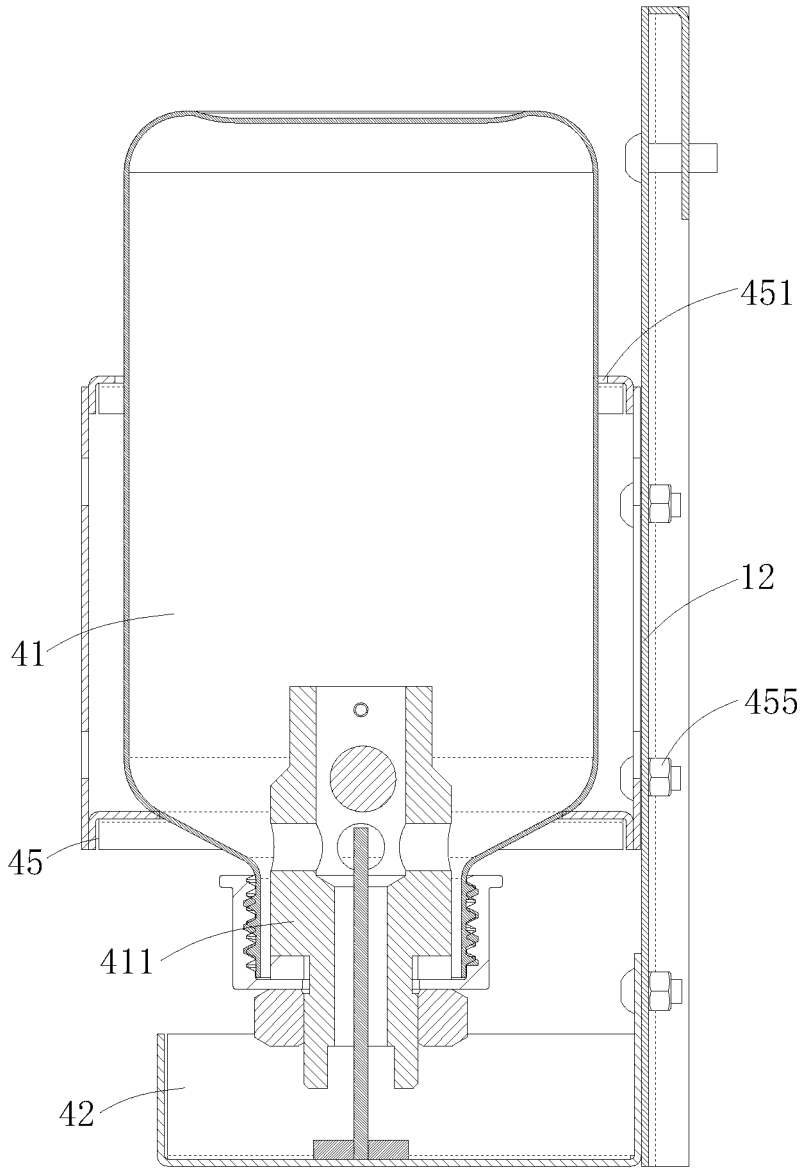
FIG. 6 is a schematic sectional view shown after a water containing bottle is placed on a water replenishing frame.

As shown in FIG. 6, a one-way valve 411 is mounted on a bottleneck of the water containing bottle 41, and the one-way valve 411 is for one-way circulation from the inside to the outside of the water containing bottle 41. Further refer to FIG. 2 and FIG. 7, a mounting plate 12 is fixed on the mounting frame of the carton sealer, the first water tank 42 is fixed below the mounting plate 12, a water replenishing frame 45 is fixed on the mounting plate 12, and an avoidance hole 451 and a limiting hole 452 are respectively formed in upper and lower surfaces of the water replenishing frame 45, wherein the aperture of the avoidance hole 451 is larger than the external diameter of the water containing bottle 41, and the aperture of the limiting hole 452 is smaller than the external diameter of the water containing bottle 41. When being placed on the water replenishing frame 45, the water containing bottle 41 is inversed, so that after the water containing bottle 41 passes through the avoidance hole 451, the bottleneck part of the water containing bottle 41 passes through the limiting hole 452 and extends into the first water tank 42, and then, the water containing bottle 41 is in a state of being located in the first water tank 42 in a way that the bottleneck faces downwards under the limitation of the water replenishing frame 45. In this state, water in the water containing bottle 41 flows into the first water tank 42 by the one-way valve 411, and when a water level in the first water tank 42 reaches a water outlet of the one-way valve 411, the water level in the first water tank 42 can be maintained on the position of the water outlet of the one-way valve 411 under the action of an atmospheric pressure, and similarly, the second water tank 43 also keeps a water level at the same height.

Figure 7:
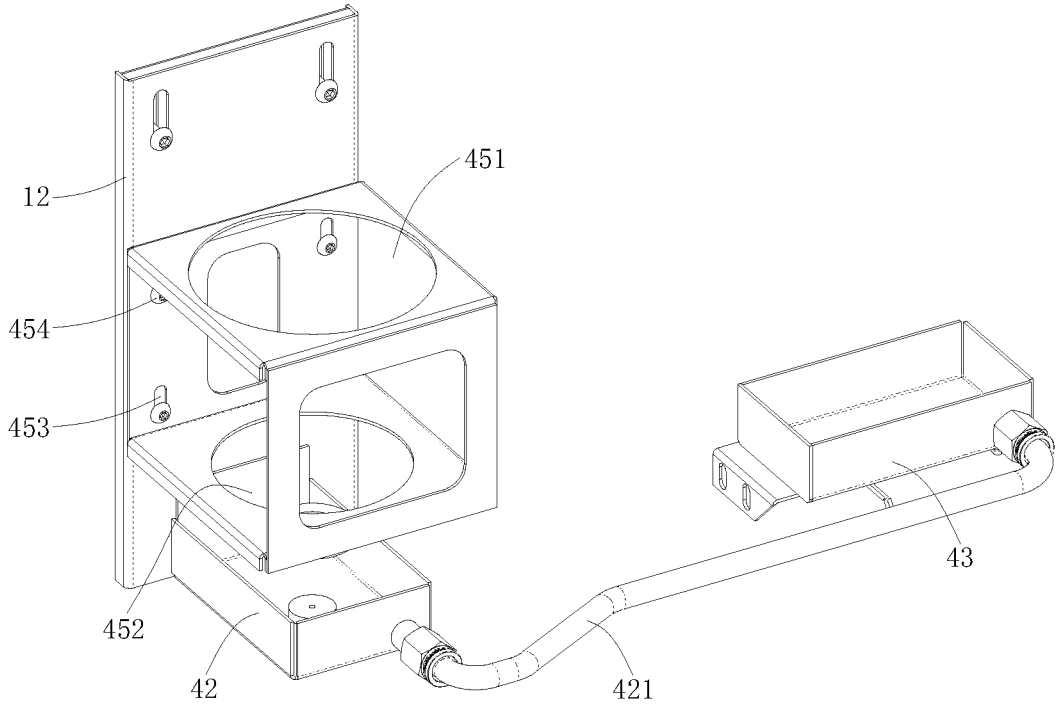
FIG. 7 is a schematic view of a three-dimensional structure that the water replenishing frame is disposed on a first water tank.

Further refer to FIG. 2 and FIG. 7, the water replenishing frame 45 is provided with vertical strip-shaped holes 453, the mounting plate 12 is provided with connecting holes (unshown in the figures), and after passing through the strip-shaped holes 453 and the connecting holes, bolts 454 are spirally connected to second nuts 455 until being fastened, so that the water replenishing frame 45 is fixed above the first water tank 42. Moreover, in this fixing structure, the water replenishing frame 45 may be vertically moved, so that the second nuts 455 are fastened after the strip-shaped holes 453 vertically move relative to the bolts 454, a height of the water replenishing frame 45 relative to the first water tank 42 is adjusted in such a way, then, a height of the water containing bottle 41 relative to the first water tank 42 is adjusted, so that the height of the water level in the first water tank 42 is controlled, and similarly, it is also equivalent to that a height of a water level in the second water tank 43 is controlled.

Figure 4:
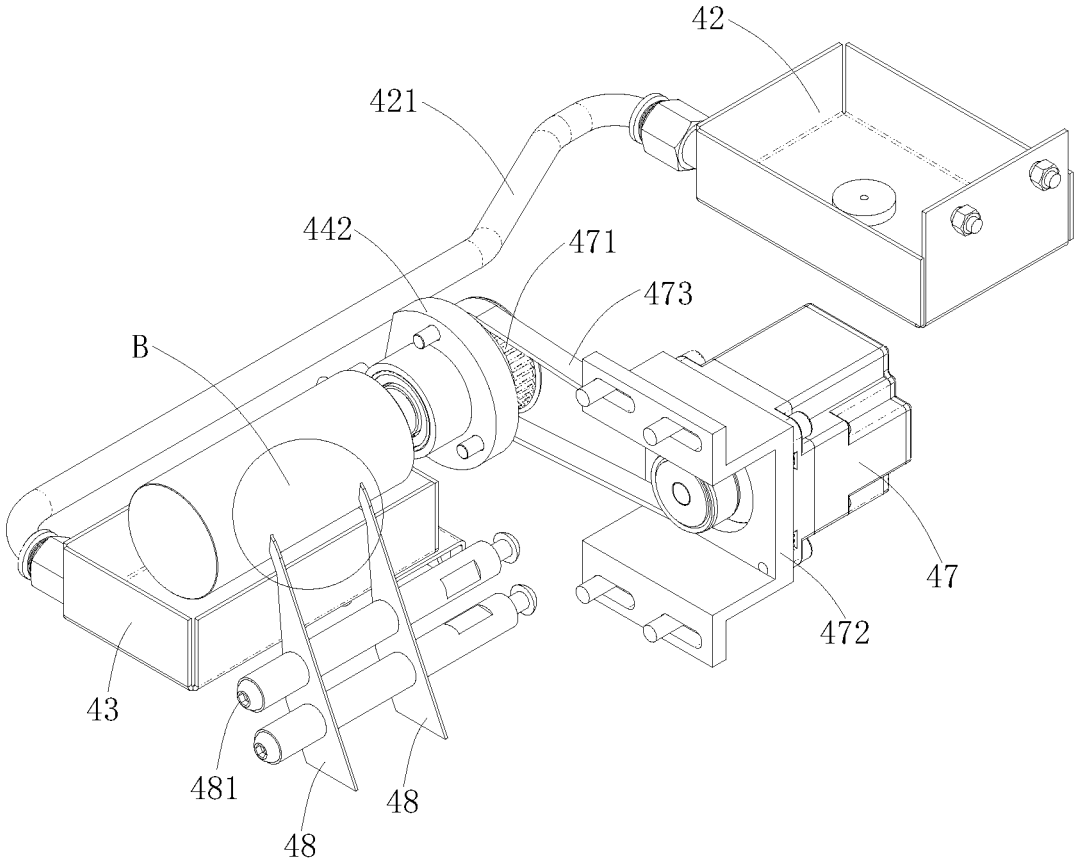
FIG. 4 is a schematic view shown after parts of structures are hidden in FIG. 1.

As shown in FIG. 4, a bearing block 442 and a wetting motor 47 are further fixed on the mounting frame of the carton sealer, wherein the wetting motor 47 may be a stepping motor. A rotating shaft (unshown in the figures) is fixed on one end of the wetting roller 44, and the rotating shaft passes through the bearing block 442 and is fixed together with the bearing block 442, so that the wetting roller 44 is limited to rotate on the second water tank 43, and a lower surface of the wetting roller 44 is located below a water level in the second water tank 43. Further, the rotating shaft is fixedly connected to a first synchronous wheel 471 after passing through the bearing block 442, an output shaft of the wetting motor 47 is fixedly connected to a second synchronous wheel 472, and the first synchronous wheel 471 and the second synchronous wheel 472 are both engaged and connected with a synchronous belt 473, so that the wetting motor 47 drives the wetting roller 44 to rotate under the transmission of the second synchronous wheel 472, the synchronous belt 473 and the first synchronous wheel 471 to form an active rotation mode of the wetting roller 44, and the wetting roller 44 is kept in a state that the surface is wetted.

Figure 8:
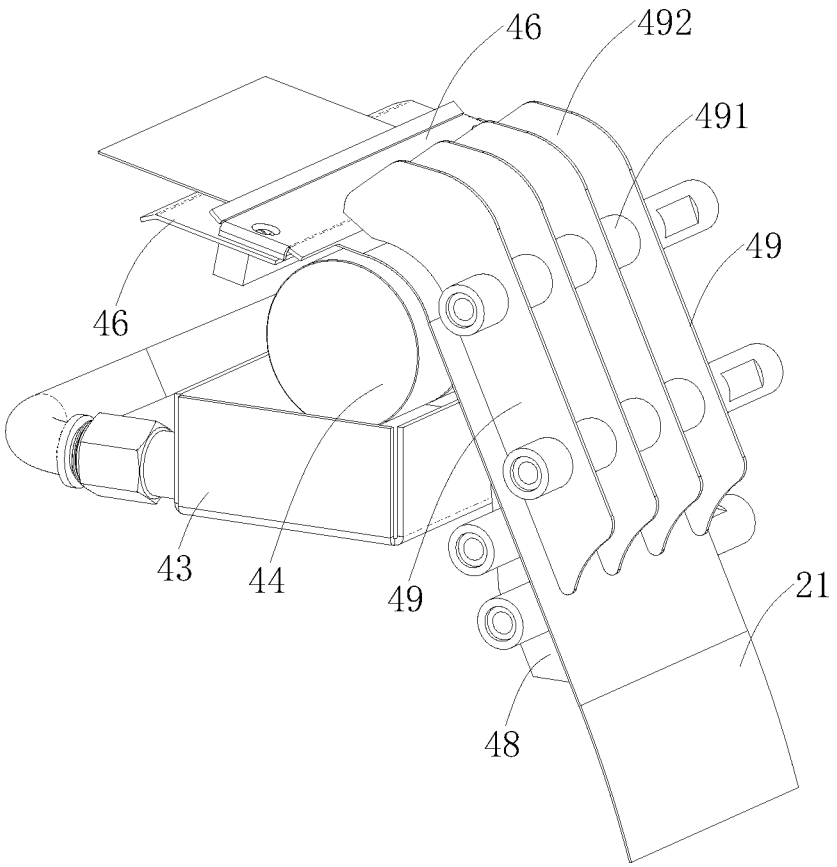
FIG. 8 is a schematic view of a three-dimensional structure that a tape is conveyed to wetting roller.

As shown in FIG. 8, one side of the wetting roller 44 is provided with two support plates 46, the two support plates 46 may be both fixed on the mounting frame of the carton sealer, after passing through a space between the two support plates 46, a tape 21 extends to the wetting roller 44, so that it is ensured that the tape 21 can smoothly move onto the wetting roller 44 after being pulled out of a tape roll 2.

Further refer to FIG. 8, a plurality of pressing plates 49 are further fixed above the wetting roller 44, each of the pressing plates 49 may be connected by a first fixing rod 491 to form a fixed whole, and an arc-shaped structure 492 sharing the same axis with the wetting roller 44 is formed above the pressing plates 49. During operation, the tape 21 passes through a gap between each of the pressing plates 49 and the wetting roller 44 to ensure that the arc-shaped structure 492 on the pressing plates 49 can limit the tape 21 to be close to the wetting roller 44 and to avoid a situation that the tape 21 is too loose to be in contact with the wetting roller 44, so that the tape 21 is kept to be stuck to an upper surface of the wetting roller 44 so as to be conveyed, and a wetting effect of the tape 21 is guaranteed.

Figure 5:
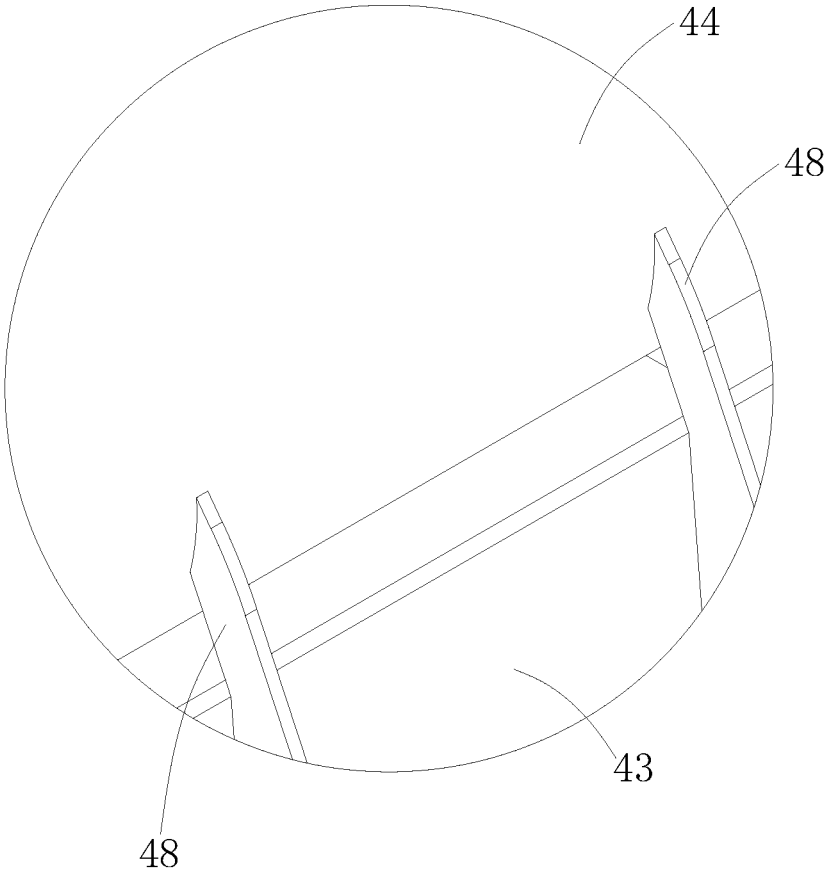
FIG. 5 is a schematic enlarged view of part B in FIG. 4.

Further refer to FIG. 4 and FIG. 5, a plurality of guide plates 48 are further disposed on one side of the wetting roller 44, and each of the guide plates 48 may be connected by a second fixing rod 481 to form a fixed whole. Surfaces on upper ends of the guide plates 48 are tangent to a surface of the wetting roller 44, so that the tape. 21 can be smoothly conveyed between each of the guide plates 48 and each of the pressing plates 49 after passing through the wetting roller.

In addition, in the case that no wetting motor 47 is disposed to drive the wetting roller 44, when the tape 21 is conveyed, the wetting roller 44 can also be driven to rotate by a friction force between the tape 21 and the wetting roller 44, and thus, a passive rotation mode of the wetting roller 44 is formed. Further, the wetting roller 44 may be made of a stainless steel plain roller, a stainless steel mesh roller or sponge roller, wherein in the active rotation mode of the wetting roller 44 driven by the wetting motor 47, the wetting roller 44 may be the stainless steel plain roller or the stainless steel mesh roller, and in the passive rotation mode of the wetting roller 44, the wetting roller 44 may be the sponge roller.

In conclusion, after the tape wetting device is disposed on the carton sealer, due to the contact between the rotating wetting roller 44 and the tape 21 when the tape 21 passes through the wetting roller 44, an adhesive surface of the tape 21 transfers and absorbs water attached to a roller surface of the wetting roller 44; and at the same time, the area of contact between the tape 21 and the wetting roller 44 is limited and controlled by the pressing plates 49, so that a wetting effect of the tape 21 is guaranteed. Thus, it can be seen that, by using the tape wetting device, water can be automatically attached to the tape 21 during the conveyance of the tape 21, and the conveyance of the tape 21 is not affected. Therefore, after the tape wetting device is added, the carton sealer is applicable to a wet tape.

The above descriptions are only specific implementations of the present disclosure, however, the design concept of the present disclosure is not limited thereto. Any non-substantive changes on the present disclosure based on this concept should fall within behaviors that violate the protection scope of the present disclosure.

What is claimed is:

1. A tape wetting device in a carton sealer, wherein the device comprises a water containing bottle, a first water tank, a second water tank and a wetting roller, wherein a one-way valve is mounted on a bottleneck of the water containing bottle, the one-way valve is for circulation from the inside to the outside of the water containing bottle, and the water containing bottle is located in the first water tank in a way that the bottleneck faces downwards;

the first water tank communicates with the second water tank, so that water in the first water tank is capable of circulating to the second water tank; and the wetting roller is limited to rotate on the second water tank, a lower surface of the wetting roller is located below a water level in the second water tank, and a tape is stuck to an upper surface of the wetting roller so as to be conveyed;

wherein a mounting plate is fixed on the carton sealer, the first water tank is fixed below the mounting plate, the mounting plate is provided with a water replenishing frame on the first water tank, an avoidance hole and a limiting hole are respectively formed in upper and lower surfaces of the water replenishing frame, the aperture of the avoidance hole is larger than the external diameter of the water containing bottle, and the aperture of the limiting hole is smaller than the external diameter of the water containing bottle; and after the water containing bottle passes through the avoidance hole, the bottleneck of the water containing bottle passes through the limiting hole and extends into the first water tank.

2. The tape wetting device in a carton sealer according to claim 1, wherein a bearing block and a wetting motor are fixed on a mounting frame of the carton sealer, one end of the wetting roller is fixed into the bearing block, and the wetting motor drives the wetting roller to rotate.

3. The tape wetting device in a carton sealer according to claim 2, wherein a rotating shaft is fixed on one end of the wetting roller, the rotating shaft is fixedly connected to a first synchronous wheel after passing through the bearing block, an output shaft of the wetting motor is fixedly connected to a second synchronous wheel, and the first synchronous wheel and the second synchronous wheel are both engaged and connected with a synchronous belt.

4. The tape wetting device in a carton sealer according to claim 1, wherein pressing plates are fixed above the wetting roller, the tape passes by a gap between each of the pressing plates and the wetting roller, and the pressing plates press against the tape.

5. The tape wetting device in a carton sealer according to claim 1, wherein the water replenishing frame is provided with vertical strip-shaped holes, the mounting plate is provided with connecting holes, and after passing through the strip-shaped holes and the connecting holes, bolts are spirally connected to second nuts until being fastened, so that the water replenishing frame is fixed above the first water tank.

6. The tape wetting device in a carton sealer according to claim 1, wherein a plurality of guide plates are further disposed on one side of the wetting roller, and surfaces on upper ends of the guide plates are tangent to a surface of the wetting roller.

7. The tape wetting device in a carton sealer according to claim 1, wherein a heatable heating plate is fitted and fixed to the bottom surface of the second water tank.

8. The tape wetting device in a carton sealer according to claim 7, wherein a fixing plate is disposed on the bottom surface of the second water tank, and the heating plate is located between the bottom surface of the second water tank and the fixing plate; and studs are fixed on the bottom surface of the second water tank and are spirally connected to first nuts, all corners of the fixing plate are provided with fixing holes, after the studs are sleeved in the fixing holes, the first nuts and the studs are spirally fastened on a side, facing away from the second water tank, of the fixing plate.

9. A tape wetting device in a carton sealer, wherein the device comprises a water containing bottle, a first water tank, a second water tank and a wetting roller, wherein a one-way valve is mounted on a bottleneck of the water containing bottle, the one-way valve is for circulation from the inside to the outside of the water containing bottle, and the water containing bottle is located in the first water tank in a way that the bottleneck faces downwards;

the first water tank communicates with the second water tank, so that water in the first water tank is capable of circulating to the second water tank; and the wetting roller is limited to rotate on the second water tank, a lower surface of the wetting roller is located below a water level in the second water tank, and a tape is stuck to an upper surface of the wetting roller so as to be conveyed;

wherein a heatable heating plate is fitted and fixed to the bottom surface of the second water tank;

wherein a fixing plate is disposed on the bottom surface of the second water tank, and the heating plate is located between the bottom surface of the second water tank and the fixing plate; and studs are fixed on the bottom surface of the second water tank and are spirally connected to first nuts, all corners of the fixing plate are provided with fixing holes, after the studs are sleeved in the fixing holes, the first nuts and the studs are spirally fastened on a side, facing away from the second water tank, of the fixing plate.

* * * * *